United States Patent [19]

Hudson

[11] 4,014,065

[45] Mar. 29, 1977

[54] MAGNETIC DEVELOPER REMOVAL SYSTEM

[75] Inventor: Frederick W. Hudson, W. Henrietta, N.Y.

[73] Assignee: Xerox Corporation, Stamford, Conn.

[22] Filed: Aug. 27, 1975

[21] Appl. No.: 608,362

[52] U.S. Cl. ..... 15/306 R; 15/375; 15/418; 15/419; 15/421; 355/15

[51] Int. Cl.[2] ..... A47L 9/02

[58] Field of Search ..... 15/306 A, 306 R, 375, 15/393, 398, 379, 400, 415, 418, 419, 421; 355/15

[56] References Cited

UNITED STATES PATENTS

| | | | |
|---|---|---|---|
| 1,038,383 | 9/1912 | Jones | 15/398 X |
| 2,028,847 | 1/1936 | Ricks et al. | 15/417 |
| 2,278,096 | 3/1942 | Ross | 15/398 X |
| 3,469,275 | 9/1969 | Deschuttere et al. | 15/345 X |
| 3,514,803 | 6/1970 | Turney, Jr. | 15/306 R |
| 3,820,189 | 12/1972 | Roth | 15/400 |
| 3,841,910 | 10/1974 | Baker | 15/306 A X |

*Primary Examiner*—Christopher K. Moore
*Attorney, Agent, or Firm*—James J. Ralabate; Richard A. Tomlin; George J. Cannon

[57] ABSTRACT

Vacuum removal means for removing excessive developer material from a member having a latent magnetic image developed with magnetic developer material. The vacuum removal means comprises a chamber having entrance and exit ports of predetermined cross-sectional area such that the ratio of entrance port to exit port is sufficiently small to assure substantially uniform air flow across the entrance port when the chamber is subjected to negative pressure through the exit port. The entrance port of the chamber is in communication with means for subjecting the developed surface of the member to a substantially uniform shearing air flow when the chamber is subjected to the negative pressure. A second entrance port of equal cross-sectional area to the first entrance port may be provided to the chamber in association with gating means for selectively varying the cross-sectional area of each entrance port while maintaining a constant combined cross-sectional area for the entrance ports.

6 Claims, 4 Drawing Figures

MAGNETIC DEVELOPER REMOVAL SYSTEM

BACKGROUND OF THE INVENTION

This invention relates to removal of magnetic developing material from a developed, magnetically latently imaged member; and, more particularly to the removal of magnetic developing material from background areas of the member.

Latently imaged members such as, for example, electrostatically latently imaged xerographic photoconductive members and latently magnetically imaged magnetographic imaging members are typically developed by deposition of developer material on the imaging member. In magnetic imaging the developing material is magnetic and attracted by magnetic fields to the latent magnetic image created in a magnetizable imaging member such as, for example, ordinary magnetic recording tape. In electrostatographic imaging systems such as, for example, xerography, the developing material typically comprises the two components of carrier and toner. The toner material is typically capable of becoming triboelectrically charged and, owing to this charge is attracted to the charge pattern residing on the photoconductive imaging member. In either case, as a practical matter, developer material is attracted to and deposited upon the imaging member not only in imagewise configuration in areas of the member corresponding to the latent image but also is deposited upon non-image areas of the imaging member.

These non-image or background areas of the imaging member which bear developing material will transfer these developer materials to the copy medium employed during transfer of the imagewise configured deposition of developing material to the copy medium. Such transfer results in reduced contrast between the transferred image and copy medium and is, therefore, generally undesirable.

Further, in developing latent magnetic images on a magnetizable member it is necessary due to the short range nature of magnetic forces (rapid decrease with distance) to introduce the developing material within a very short distance from the latent magnetic image, typically within about 10 microns of the image, to ensure development of the latent image. This extremely close proximity generally means that developing material will deposit on background areas.

The desirability of removing excessive xerographic developing material is well known and recognized in the xerographic art; and is indicated on the magnetic imaging art such as, for example, in U.S. Pat. No. 3,120,806 wherein direct flood developing of the copy medium under the influence of, but out of contact with the latent magnetic image, is followed with air-knife removal of excessive developing material.

While vacuum removal means are disclosed in the xerographic art for the purpose of removing powder clouds of xerographic developer from machine cavities, I am unaware of any vacuum removal means designed to operate directly upon the developed, latently imaged member in either the xerographic or magnetic imaging art for the purpose of removing developer material directly from background areas of the imaging member (i.e., photoconductor or magnetic tape).

In new and growing areas of technology, new methods, apparatus, compositions, and articles of manufacture are often provided in order to practice the new and growing area of technology in a new mode. The present invention relates to a new and advantageous vacuum removal means for directly removing magnetic developer material from background portions of a developed, latently magnetically imaged member.

SUMMARY OF THE INVENTION

It is, therefore, an object of the invention to provide a novel means for removing magnetic developing material from background portions of a developed member.

It is another object of this invention to provide novel vacuum removal means for the removal of magnetic developer material from background portions of a developed member.

It is still a further object of this invention to provide novel vacuum removal means capable of providing substantially uniform air-flow across the cross-sectional area of an inlet thereto.

Another object of this invention is to provide vacuum removal means having a plurality of inlets operatively associated with gating means so that each of the plurality of inlets can be selectively varied in cross-sectional area while the total combined cross-sectional inlet area for the plurality of inlets is constant.

The foregoing objects and others are accomplished in accordance with this invention by providing a chamber having entrance and exit ports such that the entrance port to exit port cross-sectional ratio is sufficiently small to assure substantially uniform air-flow across the entrance port when the chamber is subjected to negative pressure through the exit port, the entrance port of the chamber being in communication with means for subjecting a closely spaced member surface to a substantially uniform shearing air-flow when the chamber is subjected to the negative pressure. By providing a second entrance port of equal cross-sectional area to the first and with appropriate gating means, the cross-sectional area of each entrance port can be selectively varied while the combined total cross-sectional area of the plurality of entrance ports is constant.

BRIEF DESCRIPTION OF THE DRAWINGS

For a better understanding of the invention as well as other objects and further features thereof, reference is made to the following detailed disclosure of the preferred embodiments of the invention taken in conjunction with the accompanying drawings thereof, wherein.

DESCRIPTION OF THE PREFERRED EMBODIMENTS

While the following detailed description of the preferred embodiment wherein the vacuum removal means is shown and described in conjunction with a rotating drum, it will be appreciated that the present invention with minor modifications can be employed in conjunction with any form of imaging member such as, for example, a sheet, web, roll, and so forth.

Figure 1:
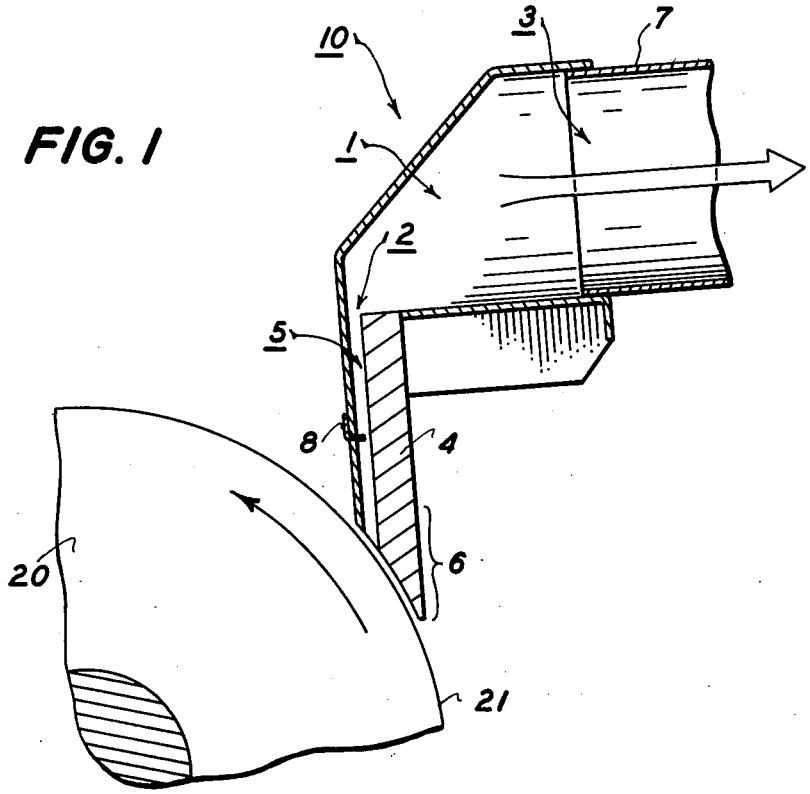
FIG. 1 is a schematic, cross-sectional illustration of an embodiment of the invention having a single entrance port.

Referring now to FIG. 1, there is seen vacuum removal means 10 having a chamber 1 which in turn, is provided with an entrance port 2 and an exit port 3. Exit port 3 of chamber 1 is in communication with conduit 4 through passage 5. Conduit 4 has an arcuate terminal portion 6 which is closely spaced apart from developed surface 21 of drum 20. Exit port 3 of chamber 1 is in communication with conduit 7 such as, for example, an air hose connecting exit port 3 with a source of negative pressure. Conduit 7 could be provided as a rigid member of relatively short length which is either permanently or temporarily affixed to vacuum removal means 10 and to which is connected appropriate means for providing communication between chamber 1 and the source of negative pressure.

By way of illustration, and without intending to be limited thereto, a typical satisfactory set of parameters is as follows: a diameter of about 3 inches for exit port 3 and conduit 7; a distance of about 3 inches from exit port to entrance port; an entrance port width of about 5 millimeters measured in the direction parallel to the plane of FIG. 1 and a length of about 3 inches; and a distance of from about 1 to about 2 millimeters between the arcuate terminal portion of conduit 4 and surface 21 of drum 20. Passage 5 of conduit 4 is provided with a loose gate to adjust the air flow through passage 5 as required. Loose gate 8 is optional and is provided purely as a matter of convenience. The embodiment depicted in FIG. 1 and without optional gate 8 will provide satisfactory removal of magnetic developing material from background areas of surface 21.

In operation, exit port 3 is connected to a source of negative pressure. With the aforementioned set of parameters and, in addition, with a length of entrance port 2 of about 3 inches in the direction normal to the plane of FIG. 1, the ratio of the cross-sectional area of the entrance port 2 to exit port 3 is small enough (for example, about 1 to 12 in the illustrative set of data) to assure that the air-flow across entrance port 2 into chamber 1 and out of exit port 3 is substantially uniform. This, in turn, will assure that the atmospheric response of air flow in between surface 21 and terminal portion 6 of conduit 4 and into passage 5 of conduit 4 is substantially uniform. This result is preferred in order to subject any developed image residing on surface 21 to substantially uniform removal force. The removal force is provided by air flow between terminal portions 6 and surface 21 and owing to the close, spaced-apart relationship between terminal portion 6 and surface 21 is a shearing air flow. In short, magnetic developer material is thereby subjected to a shearing force.

Figure 2:
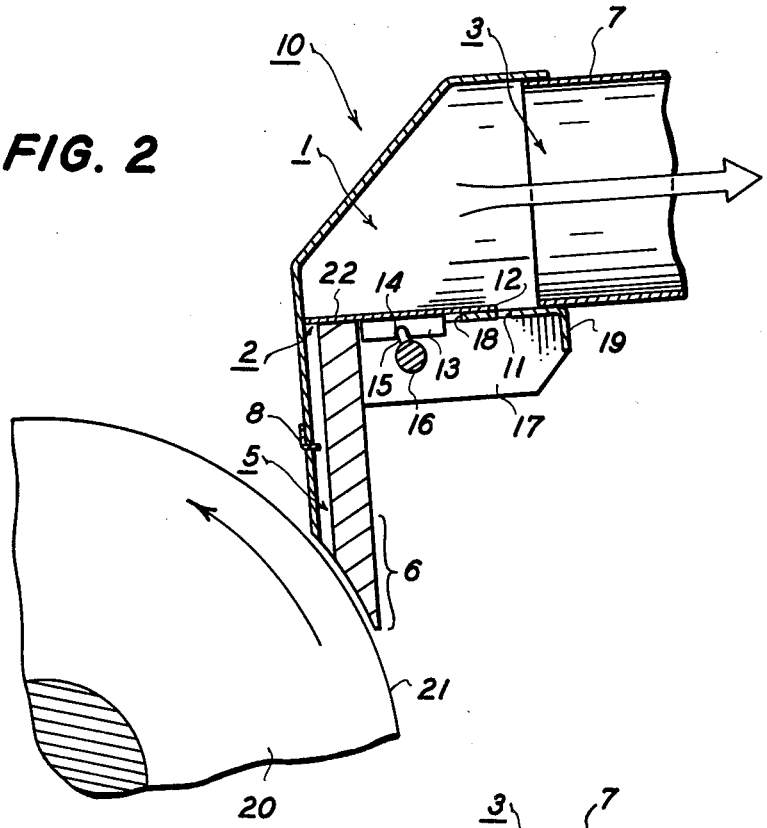
FIG. 2 is a schematic, cross-sectional illustration of an embodiment of the present invention having a plurality of entrance ports and gating means for selectively varying the effective cross-sectional area of each entrance port.

Referring now to FIG. 2, a second embodiment of the invention having a plurality of entrance ports is schematically illustrated. Numbers appearing in FIG. 2 which are the same as those appearing in FIG. 1 refer to the same elements. A second entrance port 11 to chamber 1 is provided in the embodiment of FIG. 2 and is of equal cross-sectional area of the entrance port 2. Rod 16 is rotatably mounted within frame member 17 and fixedly secured to radius bar 15. Flange 13 of gating means 12 is demountably affixed to radius bar 15 at grooves 14. Flange 13 is slidably mounted within slot 18 of wall 19. The dimensions of gating means 12 and the dimensions of members 13, 15 and 16 are such that when entrance port 2 is completely blocked, then entrance port 11 is completely open and vice versa.

Figure 3:
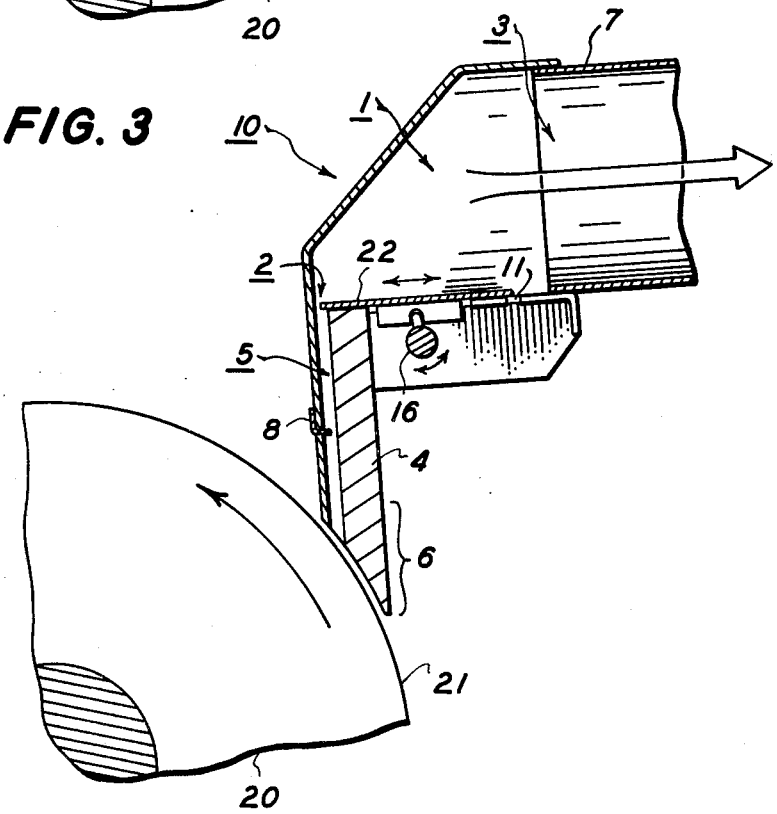
FIG. 3 is a schematic, cross-sectional view of FIG. 2 illustrating the movement of the gating means.

FIG. 3 schematically illustrates the back and forth translational movement of gating means 12 in relation to the reversible partial rotation of rod 16. Because entrance ports 2 and 11 are of equal cross-sectional area, the sum of the portions of entrance ports 2 and 11 that are in communication with the atmosphere remain constant. This feature is desirable for many reasons. Among these are included the fact that the effective cross-sectional area of the entrance port 2 in communication with the atmosphere can be varied to meet varying air flow requirements necessitated by different retention characteristics of different magnetic developing materials on different magnetic imaging members; and to increase the flow of air through entrance port 2 when filters utilized to collect removed toner downstream from entrance port 2 become partially clogged thereby affecting the flow of air through entrance port 2.

Figure 4:
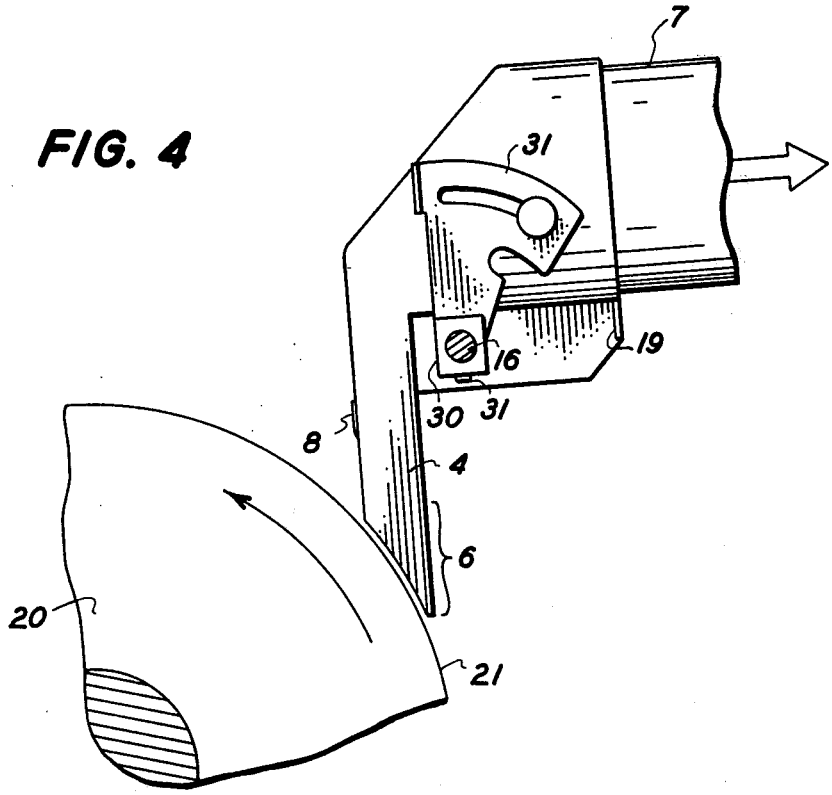
FIG. 4 is a schematic illustration of the embodiment depicted in FIGS. 2 and 3.

Referring now to FIG. 4, rod 16 is operationally connected by means of set screw 31 to flange 30 of gauge guide 31. For the aforementioned illustrative set of parameters, gauge guide 31 need only swing through an angle of about 36° to go from one extreme setting to the other. The preferred embodiment depicted in FIGS. 1 through 4 having the illustrative set of parameters performed very satisfactory in the removal of magnetic developing material from background portions of surface 21 by the use of vacuum alone.

The following tabular data illustrates the characteristic behavior of vacuum removal of magnetic developing material as a function of the parameter indicated. A flood development system was utilized; i.e., one in which magnetic developing material was deposited as a generous covering on the magnetic tape. The developer material was MAGNAFAX 611, a trademark for a magnetic toner commercially available from Surface Processes, Inc., treated by roll-milling with about 1.6% by weight SILANOX, a trademark for a fumed silicate commercially available from Cabot Corporation. The drum was wrapped with CROLYN, a trademark for chromium dioxide videotape commercially available from E. I. Dupont de Nemours, Inc. The vacuum removal means is connected to a Dust Kop, manufactured by the Aget Manufacturing Company, by a hose having an internal diameter of about three inches. Background optical density measurements were made with a densitometer subsequent to image transfer to white paper.

| Drum Speed | Width Opening of Entrance Port in Millimeters | Background Optical Density |
|---|---|---|
| | (about 5mm maximum width by about 3" long, rectangular shape) | |
| 1. 250 cm/sec. | | |
| 1A | 0 | .24 |
| 1B | .5 | .12 |
| 1C | 1.0 | .10 |
| 1D | 1.5 | .07 |
| 1E | 2.0 | .02 |
| 1F | 2.5 | .01 |
| 1G | 3 to 4.5 | .01 |

The practice of the present invention indicates that a dramatic improvement in background can be achieved with a minimum reduction in image density.

It will be appreciated by those skilled in the art that other variations and modifications can be made within the spirit of the invention.

For example, the vacuum removal means can be of any size and shape so long as substantially uniform air flow is provided through the entrance port. The conduit means for subjecting the developed member to substantially uniform shearing air flow may have any orientation between the member and the entrance port but is preferably oriented with respect to the member such that the developer material undergoes a minimum change in path of travel in going from developed member surface to entrance port. The developed member can be a web, sheet, drum or mobius strip and the invention successfully practiced with appropriate orientation of the conduit means, and the developed member is not critical; the necessary effect being the creation of substantially uniform shearing air flow therebetween. Any spacing and any design for the terminal portion of the conduit means which provides this effect can be utilized.

What is claimed is:

1. In a magnetic imaging system wherein a member having a latent magnetic image is developed with magnetic developer material, the improvement comprising: developer material removal means comprising a chamber having an entrance and exit ports; the cross-sectional area ratio of entrance port to exit port being sufficiently small to assure substantially uniform airflow across the entrance port when the chamber is subjected to negative pressure through the exit port; the entrance port of the chamber being in communication with means for subjecting the developed surface of the member to a substantially uniform shearing air flow when the chamber is subjected to the negative pressure.

2. The system according to claim 1 wherein the member is a drum.

3. The system according to claim 2 wherein the means for subjecting the developed surface of the member to a substantially uniform shearing air flow comprises a conduit having an arcuate terminal portion closely spaced apart from the drum.

4. The system according to claim 3 wherein the conduit is provided with means for adjusting the air flow through the conduit.

5. The system according to claim 1 further including a second entrance port to the chamber of equal cross-sectional area to the other entrance part; and, gating means for selectively varying the cross-sectional area of each port in communication with the atmosphere while maintaining a constant combined cross-sectional area in communication with the atmosphere for the entrance ports.

6. Apparatus for removing magnetic developer material from a member comprising:

a. a housing defining a chamber and having an entrance port and an exit port, the cross-sectional area ratio of entrance port to exit port being sufficiently small to assure substantially uniform air flow across the entrance port when the chamber is subjected to negative pressure through the exit port;

b. means for connecting the exit port to a source of negative pressure;

c. conduit means in communication with the entrance port and the atmosphere, sid conduit means terminating out of contact with but adjacent to said member; and d. a second entrance port to the chamber of equal cross-sectional area to the other entrance port; and, gating means for selectively varying the cross-sectional area of each port in communication with the atmosphere while maintaining a constant combined cross-sectional area in communication with the atmosphere for the entrance ports.

* * * * *